US005369895A

United States Patent [19]

Hammerschmidt

[11] Patent Number: 5,369,895

[45] Date of Patent: Dec. 6, 1994

[54] PLASTIC SHOE WITH VENTILATION ARRANGEMENT

[75] Inventor: Winrich Hammerschmidt, Hamburg-Schenefeld, Germany

[73] Assignee: NATEC Institut fur naturwissenschaftlichtechnische Dienste, Hamburg, Germany

[21] Appl. No.: 840,589

[22] PCT Filed: Mar. 5, 1988

[86] PCT No.: PCT/EP88/00172

§ 371 Date: Oct. 30, 1989

§ 102(e) Date: Oct. 30, 1989

Related U.S. Application Data

[63] Continuation of Ser. No. 434,680, Oct. 30, 1989, abandoned.

[51] Int. Cl.[5] ..... A43B 7/06

[52] U.S. Cl. ..... 36/3 A; 36/3 R

[58] Field of Search ..... 36/3 A, 3 R

[56] References Cited

U.S. PATENT DOCUMENTS

| | | | |
|---|---|---|---|
| 63,302 | 11/1923 | Kukovec | 36/3 A X |
| 227,811 | 5/1880 | Miller | 36/3 A X |
| 702,600 | 6/1902 | Slater | 36/3 R |
| 1,211,542 | 1/1917 | Carolin | 36/3 A |
| 1,255,451 | 2/1918 | McErlane | 36/3 A |
| 2,239,377 | 4/1941 | Altvater | 12/142 |
| 2,398,623 | 4/1946 | Daniels | 12/142 |
| 2,651,854 | 9/1953 | Taber et al. | 36/3 |
| 2,716,293 | 8/1955 | Rath | 36/3 A |
| 3,624,930 | 7/1969 | Johnson et al. | 36/43 |
| 4,032,611 | 6/1977 | Fukuoka | 264/244 |
| 4,078,321 | 3/1978 | Famolare, Jr. | 36/3 B |
| 4,080,745 | 3/1978 | Torrance | 36/3 A X |
| 4,100,685 | 7/1978 | Dassler | 36/3 B |
| 4,237,628 | 12/1980 | Etancelin | 36/131 |
| 4,322,892 | 4/1982 | Inohara | 36/29 |
| 4,408,401 | 10/1983 | Seidel et al. | 36/3 B |
| 4,476,600 | 10/1984 | Seidel et al. | 12/142 V |
| 4,505,660 | 3/1985 | Seidel et al. | 425/129 S |
| 4,562,652 | 1/1986 | Hensler | 36/102 |
| 4,571,856 | 2/1986 | Lin et al. | 36/3 A X |
| 4,693,021 | 9/1987 | Mazzarolo | 36/131 |

FOREIGN PATENT DOCUMENTS

| | | | |
|---|---|---|---|
| 0104015 | 3/1926 | Austria | 36/3 A |
| 828153 | 7/1949 | Germany . | |
| 2238811 | 2/1974 | Germany . | |
| 17228 | of 1906 | United Kingdom | 36/3 A |
| 0304093 | 1/1929 | United Kingdom | 36/3 |
| 0357391 | 9/1931 | United Kingdom | 36/3 A |
| 1182040 | 2/1970 | United Kingdom . | |

OTHER PUBLICATIONS

UK Patent Application GB 2057248 A Sasaki, Apr. 1, 1981.

Shurr Schuhrertrieb GmbH, Schwarzenbach/Saale & Anton Schur, Chem. pharm. Fabrik, Nettelal 1, *Endlich Keimrei,* undated.

*Primary Examiner*—Paul T. Sewell
*Assistant Examiner*—Ted Kavanaugh
*Attorney, Agent, or Firm*—Roylance, Abrams, Berdo & Goodman

[57] ABSTRACT

The invention relates to a plastic shoe with improved ventilation, in which the ventilation openings 7 located in the vamp area 6 of the shoe upper 5 are connected with one another by having their orifices located on the inside of the shoe upper 5 in a bulging out part 8. An additional arcuate chamber 9 is formed by the bulging out part 8 and is limited by the adjacent not bulging out part of the wall surface, which is dedicated, in connection with the ventilation openings 7, to a predetermined degree of good ventilation of the shoe in the area of the instep of the foot.

(The reference numbers are those shown in FIG. 2.)

10 Claims, 2 Drawing Sheets

PLASTIC SHOE WITH VENTILATION ARRANGEMENT

This is a continuation of application Ser. No. 07/434,680 filed Oct. 30, 1989 abandoned.

The present invention relates to a plastic shoe with ventilation.

Plastic shoes have already been known for a considerable time, both as shoes in which only certain portions, for instance the upper or insole portions, toe cap or sole, are of plastic, and also as shoes manufactured completely of plastic. Such shoes are particularly intended for special purposes, for instance to be used as beach shoes, shower clogs, athletic shoes and so forth, but are also used for general wear as work shoes and street shoes.

Unfortunately, shoes which consist entirely or essentially of plastic materials have certain drawbacks which can considerably and negatively influence their wearability which are due especially to the properties of the plastic materials which are undesirable for this sort of use, such as excessive heat insulation and lack of air permeability. Because of the defective air ventilation resulting from structural drawbacks, such shoes, particularly with long wear, produce undesirable local spots of high heat on the feet of the wearer, with the undesirable effects arising therefrom.

For this reason designers have already sought to solve this problem that known plastic shoes have been provided with ventilation openings of various configurations arid sizes arranged on the quarters or on the uppers of shoes. For instance, German patent No. 828 153 teaches a method and a device for the construction of a one-part shoe of thermoplastic material, such as polyvinyl chloride or rubber, which can be configured so that ventilation holes are formed at certain points on the shoe. However, these solutions which have been known and used up until this time are only partially satisfactory, since despite the presence of ventilation openings the local heat build-up points are frequently not reduced to the necessary degree or else when the perforations located in the shoe upper indeed are of such number that they supply sufficient ventilation, then the strength and durability of the shoe upper become insufficient.

One advantageous disclosure for the ventilation of plastic shoes is disclosed in German Printed Application 29 30 807. This specification describes a one-piece, washable and sterilizable shoe of elastic, resistant material, preferably plastic foam material, which incorporates ventilation openings in the vertical quarter area of the upper of the shoe above the edge of the sole, wherein the outside edges of the borders of the ventilation openings lie at a lower level than the corresponding inside edges of the borders of the ventilation openings. The ventilation openings are preferably at least arranged in series or in a row running around the front upper of the shoe. As a result of the special construction of these ventilation openings and their arrangement in certain areas of the shoe, good ventilation is guaranteed, particularly of the sole of the foot while it is in the shoe, while the dorsal surface of the foot or the foot instep is not so well ventilated, so that in this case heat spots can still arise, which are not prevented or even reduced by the conventional ventilation openings in the vamp area of the shoe upper, at least not to the desired degree.

The object of the present invention then is to disclose a plastic shoe in which the inherent drawbacks named above can be entirely or appreciably avoided by a simple but effective ventilation system and which also with wearing over a long period of time has exhibited a foot-friendly wearability, whereby most importantly a good ventilation of the foot, especially of the entire instep of the foot, is obtained.

This object is attained according to the invention by a plastic shoe with a ventilation arrangement, consisting of a shoe lower part with a sole and a shoe upper which is formed so that together with the lower part it forms a hollow space to receive the foot of the wearer, and ventilation openings are located at least in the surface area of the shoe upper. This shoe is characterized in that the shoe upper has a convexity or bulging out part in the vamp area, which extends over at least a portion of the area provided with ventilation openings, forming an additional arcuate space, through which the orifices of the ventilation openings located in this area on the inside of the shoe upper are in communication with one another. In one preferred embodiment the bulging out part is formed in the vamp area by suitable diminution of the wall thickness as compared with the wall thickness of the not bulged out part of the wall.

In the scope of the invention, plastic shoes include the sorts of shoes in which at least the shoe upper, but preferably the entire shoe, is of a suitable plastic material, so that on because of the heat insulating properties of the plastic portions, a ventilation of such shoes to the desired degree is obtained and is also required, for comfortable wearability of the shoes. Certain plastics, especially such plastics as those which suffice in the area of the requirements for strength, elasticity, deformability and likewise washing and sterilizing potential and/or the capacity to be disinfected are especially suitable for the shoes. The shoes according to the invention advantageously consist of foamed plastic material, for instance foamed polyurethane, on account of its remarkably low weight. However the shoes could also be manufactured of polyvinyl chloride or some similar plastic.

The plastic material used for the shoe upper or the entire shoe incorporates the desired shape by casting or injection molding of the plastic material when it is in flowable state into a suitable shape of a mold made up of a last and bottom and upper molds, in a known manner, and the ventilation openings are provided simultaneously in the vamp area of the shoe while other ventilation openings can also be formed at other points.

As opposed to typical shoe materials such as leather or canvas, which are relatively soft and adaptable to the body and in and of themselves already include generally sufficient air permeability, now relatively rigid and air-impermeable plastic materials are to be used for the manufacture of shoes, wherefor special devices must be present and available to manufacture said plastic shoes, and said special devices are to guarantee that these shoes attain an acceptable wearability. For this to be the case, the plastic shoes must be provided with ventilation openings, for instance in the vamp area of the shoe upper. However it has been shown that precisely the presence of these conventional ventilation openings in the vamp area do not alone create a satisfactory ventilation of the foot instep, because the foot instep generally engages in the vamp area rather tightly on the inside of the shoe upper and thus the ventilation openings can be more or less tightly closed off from the inside with the result that these openings cannot fulfill their ventilation function or can do so only insufficiently.

This problem is solved satisfactorily in a surprisingly simple manner with the aid of the shoe according to the invention. The bulging out part, provided in the vamp area on the inside of the shoe upper and extending over at least a portion of and preferably all of the ventilation openings present in the vamp area, makes it possible that when the orifices of the ventilation openings engage on the inside of the shoe upper, they do not directly engage the foot instep, but rather remain at some distance from the foot instep. Because of the relative rigidity of the plastic material, the additional arcuate space (called the "dome"), formed by the bulging out part, remains over the foot instep and is essentially held in place by the component parts and thus supports the orifices of the ventilation openings and covers them on the inside of the shoe upper without engaging the foot instep to thus make them nonfunctional as ventilation mechanisms. Quite the contrary, the individual orifice openings are now free and can communicate with one another through the arcuate space, whereupon an effective ventilation system for the entire foot instep is disclosed, and, likewise supported by further ventilation openings, for instance at the sides, such as for instance are described in German Printed Application 29 30 807. As a result of this ventilation system according to the invention, it is noted that the air circulation in the article is conveyed and is simplified in its conveyance away from the heat build-up point especially in the relevant foot part. Another advantage resides in that the bulging out part which is provided is not visible from tile outside in the preferred embodiment disclosed in Claim 2 and thus cannot be a negative factor in the appearance of the shoe.

Other advantageous embodiments of the invention are disclosed in Claims 3 and 4.

The invention is to be described hereinafter relative to the drawings. In the drawings.

Figure 1:
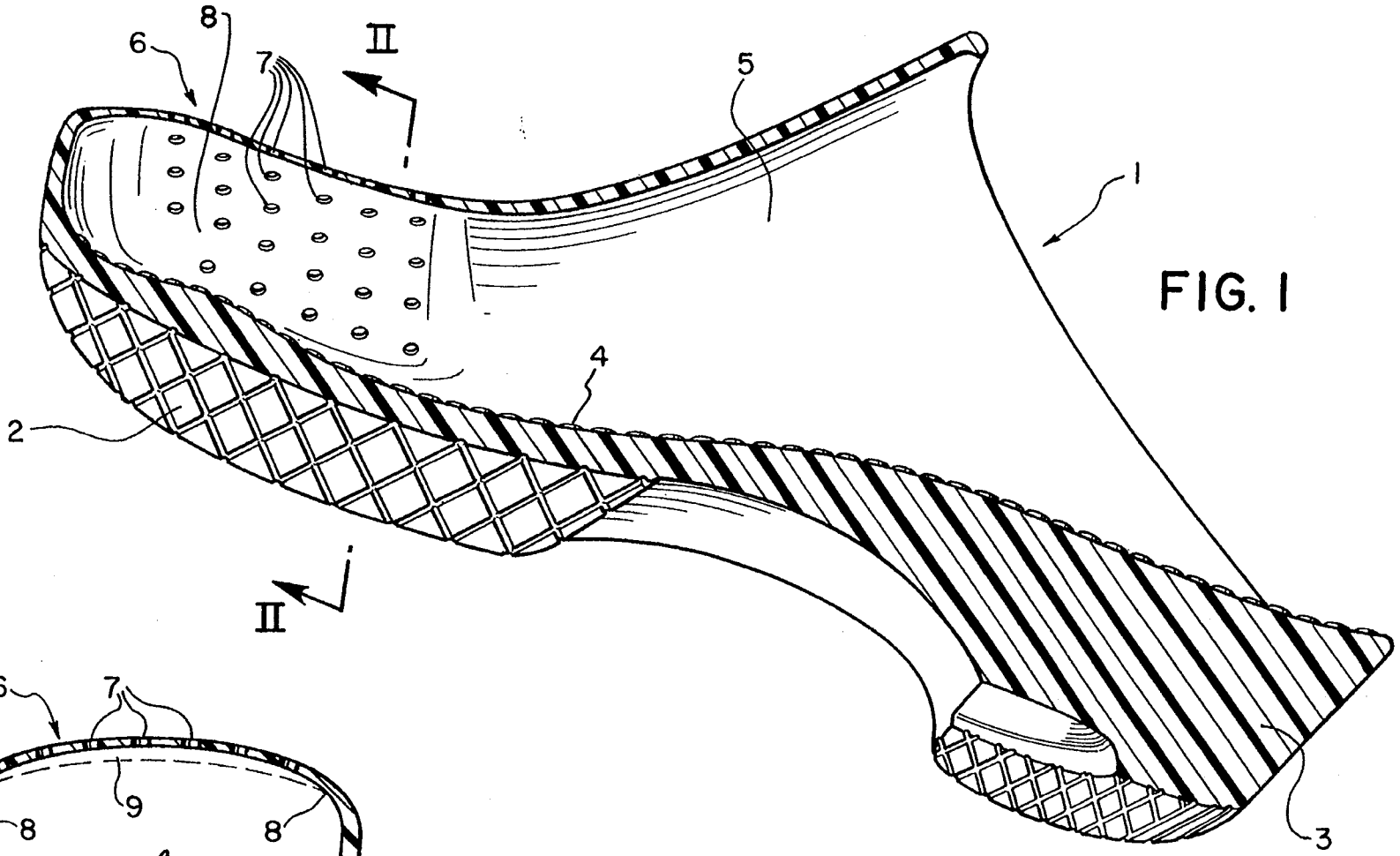
FIG. 1 is a lengthwise cross section through one embodiment of the plastic shoe according to the invention with a perspective representation of the vamp area in the inside of the shoe.

The shoe according to the invention is shown in its entirety in FIG. 1. The shoe consists of lower part with sole 2 and heel 3, which in the embodiment which is shown is offset from the sole. The foot resting surface is 4 and the shoe upper 5. Upper 5 and shoe lower part together form a hollow space to receive the front and midsection parts of the wearer's foot. In the embodiment which is shown the upper is terminated with a slip opening freeing the heel of the foot, whereby the foot can slip comfortably into and out of the shoe. Of course other embodiments may be provided, for instance an embodiment in which the shoe 1 is provided with a counter, which can be configured to rise up sufficiently that the heel of the foot is surrounded by it and is protected.

Figure 2:
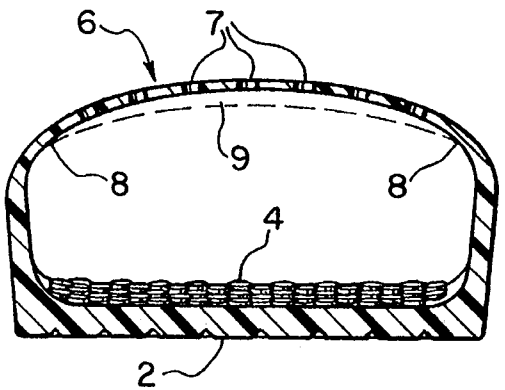
FIG. 2 is a transverse section through the front portion of the shoe of FIG. 1 along the line A—A.
Figure 3:
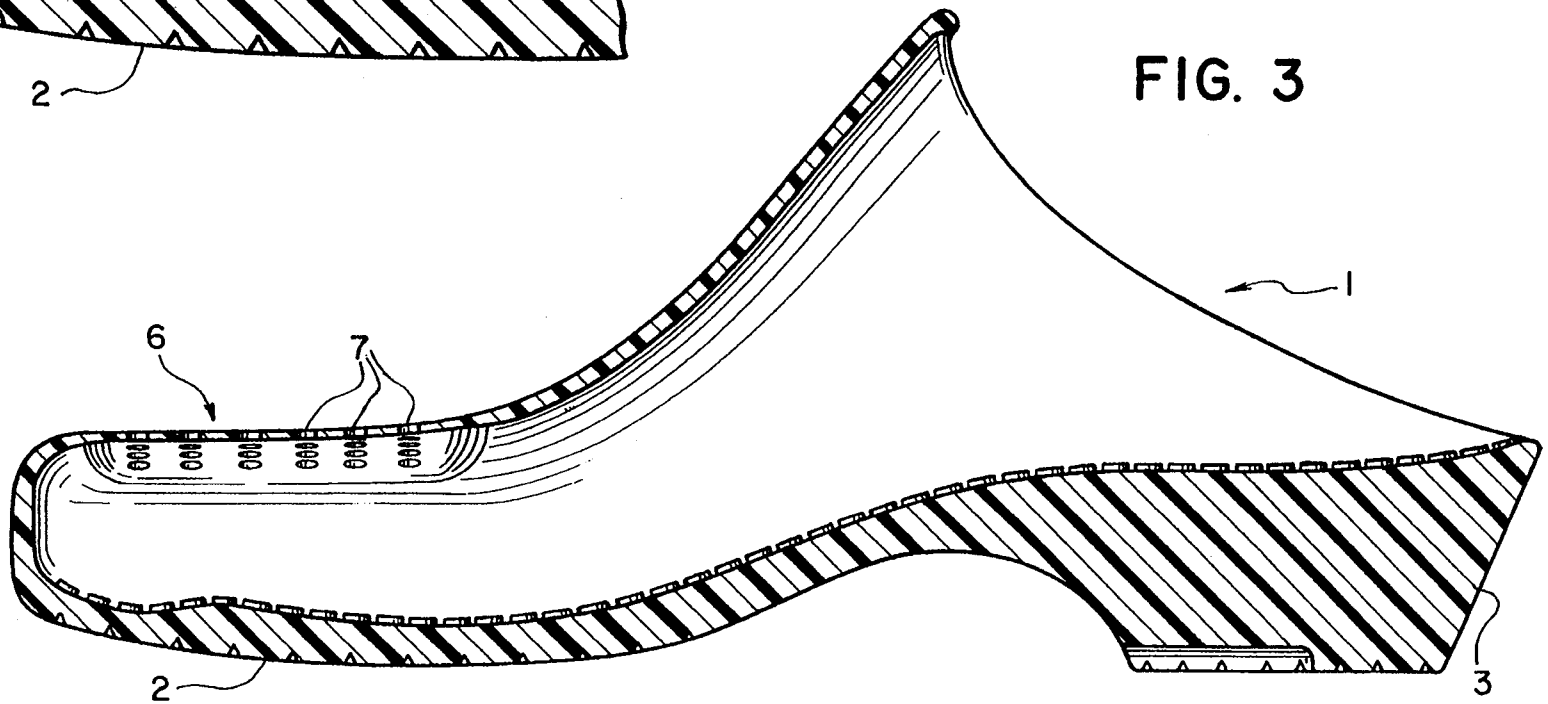
FIG. 3 is a side elevational view in longitudinal cross-section of the shoe of FIGS. 1 and 2.
Figure 4:
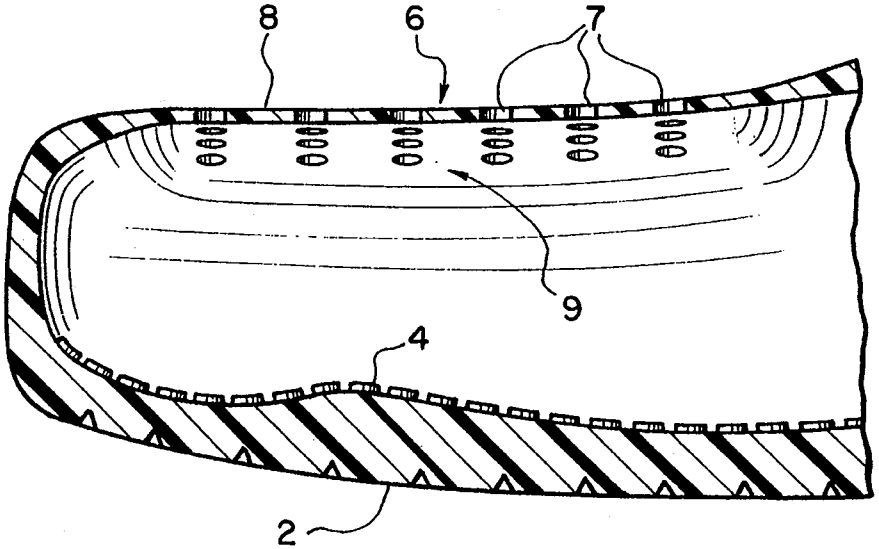
FIG. 4 is an enlarged, partial, side elevational view in longitudinal cross-section of the shoe of FIG. 3.

Shoe 1 shown in FIG. 1 has a plurality of ventilation openings 7 in the vamp area 6 which surrounds and covers the greater portion of the front part of shoe upper 5, which is more or less horizontal, and the openings should serve for ventilation of the foot instep. The inside surface of upper 5 in vamp area 6, as shown in FIG. 1, exhibits a bulging out part 8, which in the embodiment shown in FIGS. 1 and 2 extends over all of the ventilation openings 7. So that bulging out part 8 on the inside of shoe upper 5 is not visible from the outside, said bulging out part 8 is constructed on the inside of upper 5 in the vamp area 6 formed by corresponding suitable diminution of the wall thickness as compared with the wall thickness of the not bulged out part of the wall. It is preferable that the areas of transition from the not bulged out part of the wall to the bulged out part of the wall, of which the surface as compared with the surface of the not bulged out part of the wall springs back into shape for a certain distance, occur as smoothly as possible, in other words as nearly as possible without construction of shoulders or edges, as for instance is shown in FIG. 2. Some possible drawbacks occuring during wearing of the shoe are thus avoided, such as the appearance of pressure points which could be produced by sharp transition points in the border area of bulged out part 8.

When it is of no importance or even is desired that bulged out part 8 in vamp area 6 be visible on the shoe from the outside, bulged out part 8 can also be configured in such a manner that the wall area in which part 8 is to be located be displaced outward to a desired predetermined distance without change of the wall thickness for the outward displacement as compared with the not bulged out wall part, so that bulged out part 8 on the inside of upper 5 is characterized by a suitably formed elevated part on the outside of shoe upper 5.

On account of the simpler method of manufacture and for esthetic and practical reasons, however, one embodiment is preferred, in which bulging out part 8 is formed by suitable diminution of the wall thickness in comparison with the wall thickness of the not bulging out part of the wall and bulging out part 8 is not visible from the outside. One embodiment of the plastic shoe according to the invention is especially preferred in which the wall thickness in the bulging out wall area is at least 25% and at the most 75% thinner than the thickness of the not bulging out wall part. One embodiment is especially preferred in which the wall thickness in the bulging out wall area is 50% thinner than that of the not bulging out wall.

An additional arcuate chamber or recess 9 summarily indicated as a dome is formed as a result of having bulging out part 8 in the inside of shoe upper 5 in vamp area 6, and is limited by the adjacent not bulging out wall part, through which the orifices of ventilation openings 7 located in this area can communicate with one another. Good ventilation of the entire long period.

The present explanations show only exemplary constructions of the disclosure of the invention. Of course it is to be understood that modifications and other constructions are possible in which similar use is made of the disclosure of the present invention.

I claim:

1. A ventilated shoe, the combination comprising:

a lower part having a sole portion with a foot supporting surface; and a plastic upper part coupled to said lower part with a space formed between said upper and lower parts for receiving a foot of a wearer, said upper part having a wall with an inside surface, an outside surface, and a vamp area with a plurality of ventilation openings extending between said inside and outside surfaces for ventilating said space and an arcuate recess formed on said inside surface of said wall and extending between said ventilation openings in said vamp area;

said inside surface being substantially smooth and free of abrupt transitions along said inside surface of said upper part.

2. A ventilated shoe according to claim 1, wherein said arcuate recess is formed by gradually reducing the thickness of said wall of said upper part along said inside surface.

3. A ventilated shoe according to claim 2, wherein said wall along said arcuate recess is approximately 25% to 75% thinner than said wall along the remaining portions of said upper part.

4. A ventilated shoe according to claim 3, wherein said wall along said arcuate recess is approximately 50% thinner than said wall along the remaining portions of said upper part.

5. A ventilated shoe according to claim 2, wherein said outside surface of said upper part along said arcuate recess forms a smooth transition with said outside surface of said upper part along the remaining portions of said upper part.

6. A ventilated shoe, the combination comprising:

a lower part having a sole portion with a foot supporting surface; and a plastic upper part coupled to said lower part with a space formed between said upper and lower parts for receiving a foot of a wearer, said upper part having a wall with an inside surface, an outside surface, and a vamp area with a plurality of ventilation openings extending between said inside and outside surfaces for ventilating said space and a single, continuous, arcuate recess formed on said inside surface of said wall, said arcuate recess extending between said ventilation openings in said vamp area;

said inside surface being substantially smooth and free of abrupt transitions along said inside surface of said upper part.

7. A ventilated shoe according to claim 6, wherein said arcuate recess is formed by gradually reducing the thickness of said wall of said upper part along said inside surface.

8. A ventilated shoe according to claim 7, wherein said wall along said arcuate recess is approximately 25% to 75% thinner than said wall along the remaining portions of said upper part.

9. A ventilated shoe according to claim 8, wherein said wall along said arcuate recess is approximately 50% thinner than said wall along the remaining portions of said upper part.

10. A ventilated shoe according to claim 7, wherein said outside surface of said upper part along said arcuate recess forms a smooth transition with said outside surface of said upper part along the remaining portions of said upper part.

* * * * *